US011841637B1

(12) United States Patent
Sako et al.

(10) Patent No.: US 11,841,637 B1
(45) Date of Patent: Dec. 12, 2023

(54) DEVELOPING DEVICE AND IMAGE FORMING APPARATUS

(71) Applicant: FUJIFILM Business Innovation Corp., Tokyo (JP)

(72) Inventors: Kiyoshi Sako, Kanagawa (JP); Chihiro Hagiwara, Kanagawa (JP); Keiji Sanekata, Kanagawa (JP); Masayuki Shimoda, Kanagawa (JP); Kento Terashima, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/984,205

(22) Filed: Nov. 9, 2022

(30) Foreign Application Priority Data

May 27, 2022 (JP) ..... 2022-086993

(51) Int. Cl.
*G03G 15/08* (2006.01)

(52) U.S. Cl.
CPC ..... *G03G 15/0812* (2013.01); *G03G 15/0817* (2013.01)

(58) Field of Classification Search
CPC ..... G03G 15/0812; G03G 15/0817; G03G 15/0822; G03G 15/0887; G03G 15/0881; G03G 15/0898; G03G 15/0893; G03G 15/0891
See application file for complete search history.

(56) References Cited

U.S. PATENT DOCUMENTS

| | | | | |
|---|---|---|---|---|
| 8,139,976 | B2 | 3/2012 | Ito et al. | |
| 2014/0126928 | A1* | 5/2014 | Batori | G03G 15/0881 399/106 |
| 2016/0187810 | A1* | 6/2016 | Miyauchi | G03G 15/0812 399/284 |

FOREIGN PATENT DOCUMENTS

| | | |
|---|---|---|
| JP | 2002372862 | 12/2002 |
| JP | 2009145674 | 7/2009 |
| JP | 5142894 | 2/2013 |

* cited by examiner

*Primary Examiner* — Sandra Brase
(74) *Attorney, Agent, or Firm* — JCIPRNET

(57) ABSTRACT

A developing device includes: a storage part in which a developer is stored; a transport body that includes a spiral blade and transports the developer via a rotation thereof; a developing body to which the developer is supplied from the transport body; an attachment part which is disposed between the transport body and the developing body and includes an opening allowing the developer supplied from the transport body to the developing body to pass and to which a sealing member sealing the opening is detachably attached; and a connection portion which extends to cross the opening at a spiral angle of the blade as viewed from the developing body toward the transport body and of which one end portion and the other end portion are connected to the attachment part.

14 Claims, 10 Drawing Sheets

DEVELOPING DEVICE AND IMAGE FORMING APPARATUS

CROSS-REFERENCE TO RELATED APPLICATIONS

This application is based on and claims priority under 35 USC 119 from Japanese Patent Application No. 2022-086993 filed May 27, 2022.

BACKGROUND

(i) Technical Field

The present invention relates to a developing device and an image forming apparatus.

(ii) Related Art

JP2002-372862A discloses a developing device. This developing device includes: a housing in which an opening portion facing an image carrier on which an electrostatic latent image is to be formed and a developer storage portion in which a developer is stored are formed; a developer carrier that is rotatably attached to the housing near the opening portion and carries the developer stored in the developer storage portion to transport the developer up to a development region facing the image carrier; and a partition frame part which is formed at a portion of the housing between the developer carrier and the developer storage portion and to which a partition film to be peeled off and removed immediately before use is attached. The partition frame part is formed of a partition frame plate that is formed in the shape of a plate including a frame portion to which a part of the partition film is to be attached and an opening portion which allows the developer to pass and that is attached in a case where the frame portion is inserted into an attachment groove formed in the housing.

JP2009-145674A discloses a developing device. This developing device includes: a housing that includes an opening portion open toward an image carrier on which an electrostatic latent image is to be formed and a developer storage portion in which a developer is stored; a developer carrier that is rotatably attached to the housing near the opening portion and carries the developer stored in the developer storage portion to transport the developer up to a development region facing the image carrier; a partition frame body that includes a communication hole provided in a groove formed in a portion of the housing between the developer carrier and the developer storage portion and allowing the developer storage portion to communicate with the opening portion; a partition part that is provided on one of the surface and back of the partition frame body, closes the communication hole during no use to isolated the developer storage portion from the opening portion, and is peeled off immediately before use to open the communication hole and to allow the developer storage portion to communicate with the opening portion; and a close contact part that is provided at a portion where the partition frame body is inserted into the groove of the housing to allow the partition frame body to be in close contact with the groove.

SUMMARY

A developing device including a storage part in which a developer is stored, a transport body that includes a spiral blade and transports the developer via the rotation thereof, a developing body to which the developer is supplied from the transport body, and an attachment part which is disposed between the transport body and the developing body and includes an opening allowing the developer supplied from the transport body to the developing body to pass and to which a sealing member sealing the opening is detachably attached is considered as a developing device.

In a case where the developing device includes a connection portion which extends to cross the opening in a direction orthogonal to a direction corresponding to a spiral angle of the blade as viewed from the developing body toward the transport body and of which one end portion and the other end portion are connected to the attachment part, the connection portion may hinder the movement of the developer supplied from the transport body to the developing body. For this reason, the poor supply of the developer from the transport body to the developing body may occur.

Aspects of non-limiting embodiments of the present disclosure relate to a developing device and an image forming apparatus that suppress the poor supply of a developer from a transport body to a developing body as compared to a case where a connection portion extends in a direction orthogonal to a direction corresponding to a spiral angle of a blade.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a developing device including: a storage part in which a developer is stored; a transport body that includes a spiral blade and transports the developer via a rotation thereof; a developing body to which the developer is supplied from the transport body; an attachment part which is disposed between the transport body and the developing body and includes an opening allowing the developer supplied from the transport body to the developing body to pass and to which a sealing member sealing the opening is detachably attached; and a connection portion which extends to cross the opening at a spiral angle of the blade as viewed from the developing body toward the transport body and of which one end portion and the other end portion are connected to the attachment part.

BRIEF DESCRIPTION OF THE DRAWINGS

Exemplary embodiment(s) of the present invention will be described in detail based on the following figures, wherein.

DETAILED DESCRIPTION

Examples of exemplary embodiments of the present invention will be described below with reference to the drawings.

Image Forming Apparatus 10

Figure 1:
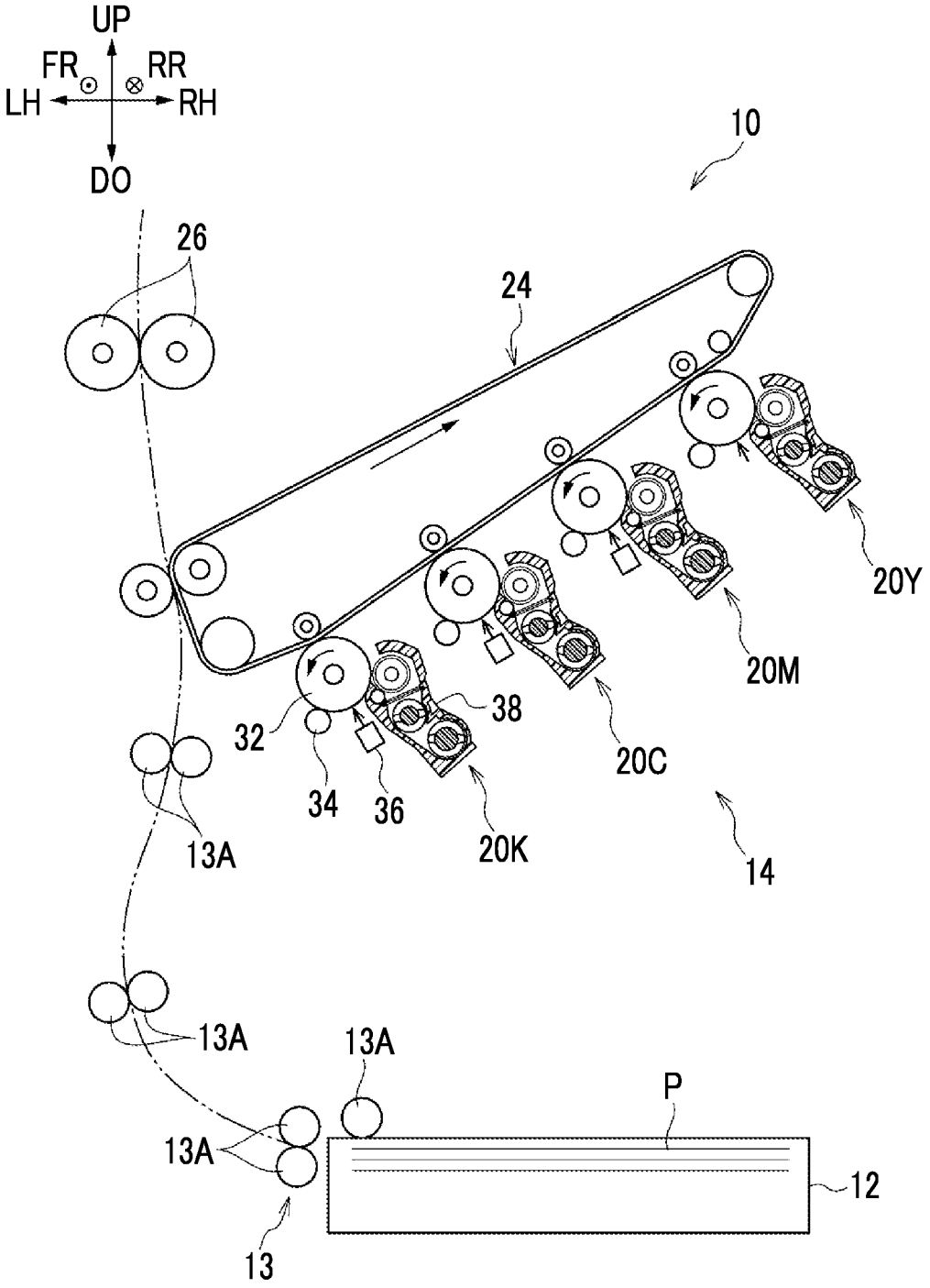
FIG. 1 is a schematic diagram showing an image forming apparatus according to a present exemplary embodiment.

The configuration of an image forming apparatus 10 according to the present exemplary embodiment will be described. FIG. 1 is a schematic diagram showing the configuration of the image forming apparatus 10 according to the present exemplary embodiment.

An arrow UP shown in the drawings indicates the upper side of the apparatus (specifically, a vertical upper side) and an arrow DO indicates the lower side of the apparatus (specifically, a vertical lower side). Further, an arrow LH shown in the drawings indicates the left side of the apparatus and an arrow RH indicates the right side of the apparatus. Furthermore, an arrow FR shown in the drawings indicates the front side of the apparatus and an arrow RR indicates the rear side of the apparatus. Since these directions are directions defined for the convenience of description, the configuration of the apparatus is not limited to these directions. The word "apparatus" may be omitted in each direction of the apparatus. That is, for example, "the upper side of the apparatus" may be simply referred to as "the upper side".

Further, "left-right direction" may be used to mean "both a right side and a left side" or "any one of the right side or the left side" in the following description. "Left-right direction" may also be referred to as a lateral side, a lateral direction, and a horizontal direction. "Front-rear direction" may be used to mean "both a front side and a rear side" or "any one of the front side or the rear side". "Front-rear direction" may also be referred to as a lateral side, a lateral direction, and a horizontal direction. Furthermore, the up-down direction, the left-right direction, and the front-rear direction are directions intersecting with each other (specifically, directions orthogonal to each other).

Further, a symbol in which "x" is written in "o" in the drawings means an arrow from the front to the back of the plane of the paper. Furthermore, a symbol in which "·" is written in "o" in the drawings means an arrow from the back to the front of the plane of the paper.

The image forming apparatus 10 shown in FIG. 1 is an apparatus for forming an image. Specifically, as shown in FIG. 1, the image forming apparatus 10 includes a medium storage part 12, a transport unit 13, and an image forming unit 14. Each part of the image forming apparatus 10 will be described below.

Medium Storage Part 12 and Transport Unit 13

The medium storage part 12 is a part that stores recording mediums P in the image forming apparatus 10. The recording mediums P stored in the medium storage part 12 are supplied to the image forming unit 14. The recording medium P stored in the medium storage part 12 is an object on which images are to be formed by the image forming unit 14. Examples of the recording medium P include a sheet, a film, and the like. Examples of the film include a resin film, a metal film, and the like. The recording medium P is not limited to the above-mentioned mediums and various recording mediums can be used.

The transport unit 13 transports the recording mediums P stored in the medium storage part 12 to a discharge unit (not shown). Specifically, as shown in FIG. 1, the transport unit 13 includes transport members 13A, such as a plurality of transport rollers, and transports the recording mediums P by the transport members 13A. Examples of the transport members 13A include transport members, such as a transport belt and a transport drum, and various transport members can be used.

Image Forming Unit 14

The image forming unit 14 forms images on the recording medium P that is transported by the transport unit 13 (specifically, the transport members 13A). Specifically, the image forming unit 14 forms toner images (an example of images) on the recording medium P by an electrophotographic method. More specifically, as shown in FIG. 1, the image forming unit 14 includes toner image forming units 20Y, 20M, 20C, and 20K (hereinafter, referred to as 20Y to 20K), a transfer body 24, and a fixing unit 26.

Each of the toner image forming units 20Y to 20K includes a photoreceptor 32. Since the toner image forming units 20Y to 20K have an identical configuration, the reference numerals of the respective parts of the toner image forming units 20Y, 20M, and 20C are omitted in FIG. 1.

The photoreceptor 32 is an example of a holding body, and is a structure that holds a latent image. Specifically, the photoreceptor 32 is rotated in one direction (for example, a counterclockwise direction in FIG. 1). A charging device 34, an exposure device 36, and a developing device 38 are provided around the photoreceptor 32 in order from an upstream side in the rotation direction of the photoreceptor 32.

In each of the toner image forming units 20Y to 20K, the charging device 34 charges the photoreceptor 32 (charging step). In addition, the exposure device 36 exposes the photoreceptor 32, which is charged by the charging device 34, to forma latent image (specifically, an electrostatic latent image) on the photoreceptor 32 (exposure step). The photoreceptor 32 holds the latent image formed by the exposure device 36.

Then, the developing device 38 develops the latent image that is held by the photoreceptor 32 (developing step). Accordingly, a toner image is formed on the photoreceptor 32. The specific configuration of the developing device 38 will be described later.

In the image forming unit 14, the respective toner image forming units 20Y to 20K perform the respective steps, such as charging, exposure, and development, to form toner images having the respective colors, such as yellow (Y), magenta (M), cyan (C), and black (K), on the transfer body 24. In addition, the image forming unit 14 transfers the toner images having the respective colors, which are formed on the transfer body 24, to the recording medium P and fixes the toner images to the recording medium P by the fixing unit 26. The image forming unit 14 uses an intermediate transfer method of transferring an image to the recording medium P via the transfer body 24 in this way.

The image forming unit may use a direct transfer method of directly transferring an image to a recording medium P without being limited to an intermediate transfer method, and various image forming units can be applied.

Developing Device 38

Figure 2:
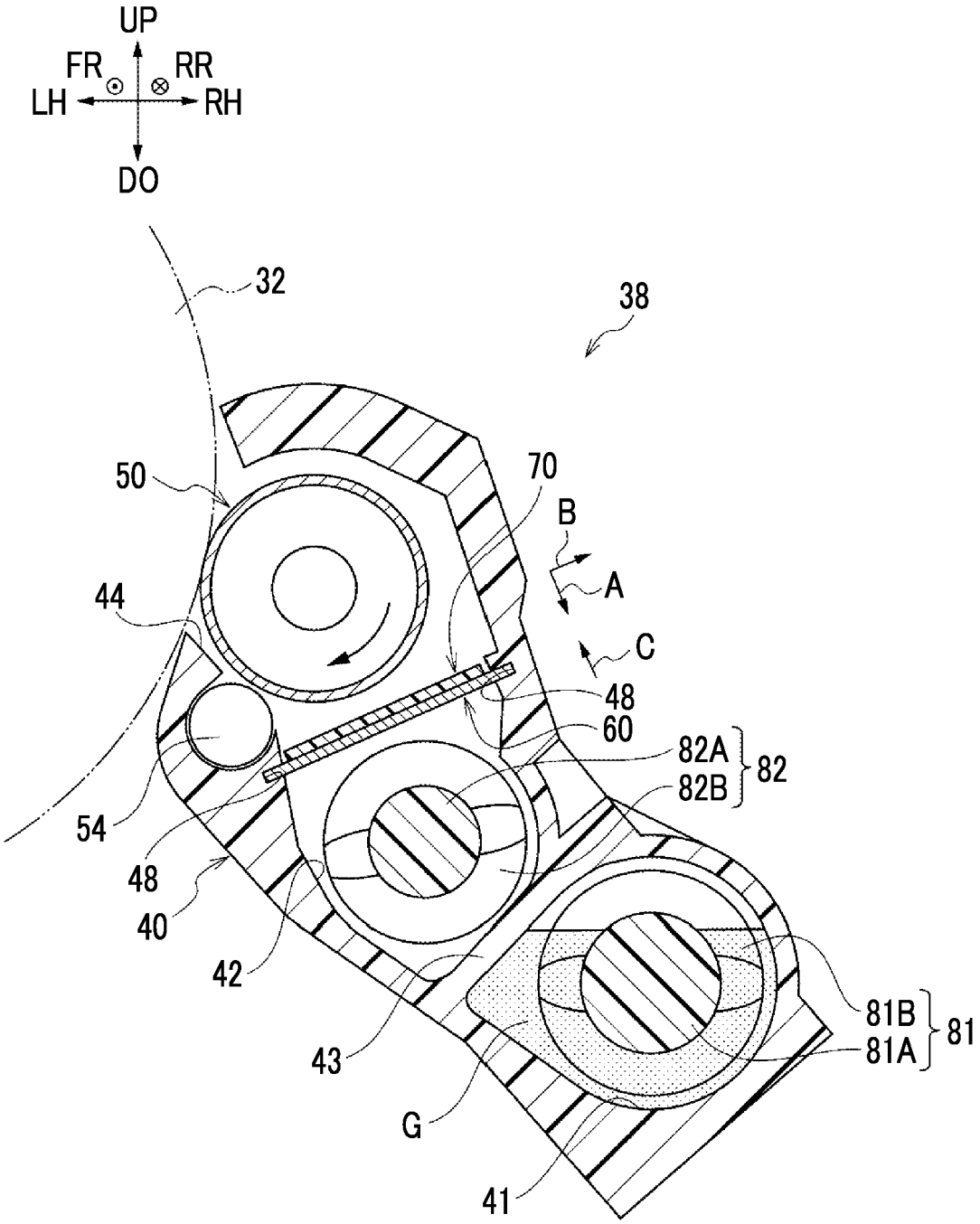
FIG. 2 is a schematic diagram showing a developing device according to the present exemplary embodiment.
Figure 3:
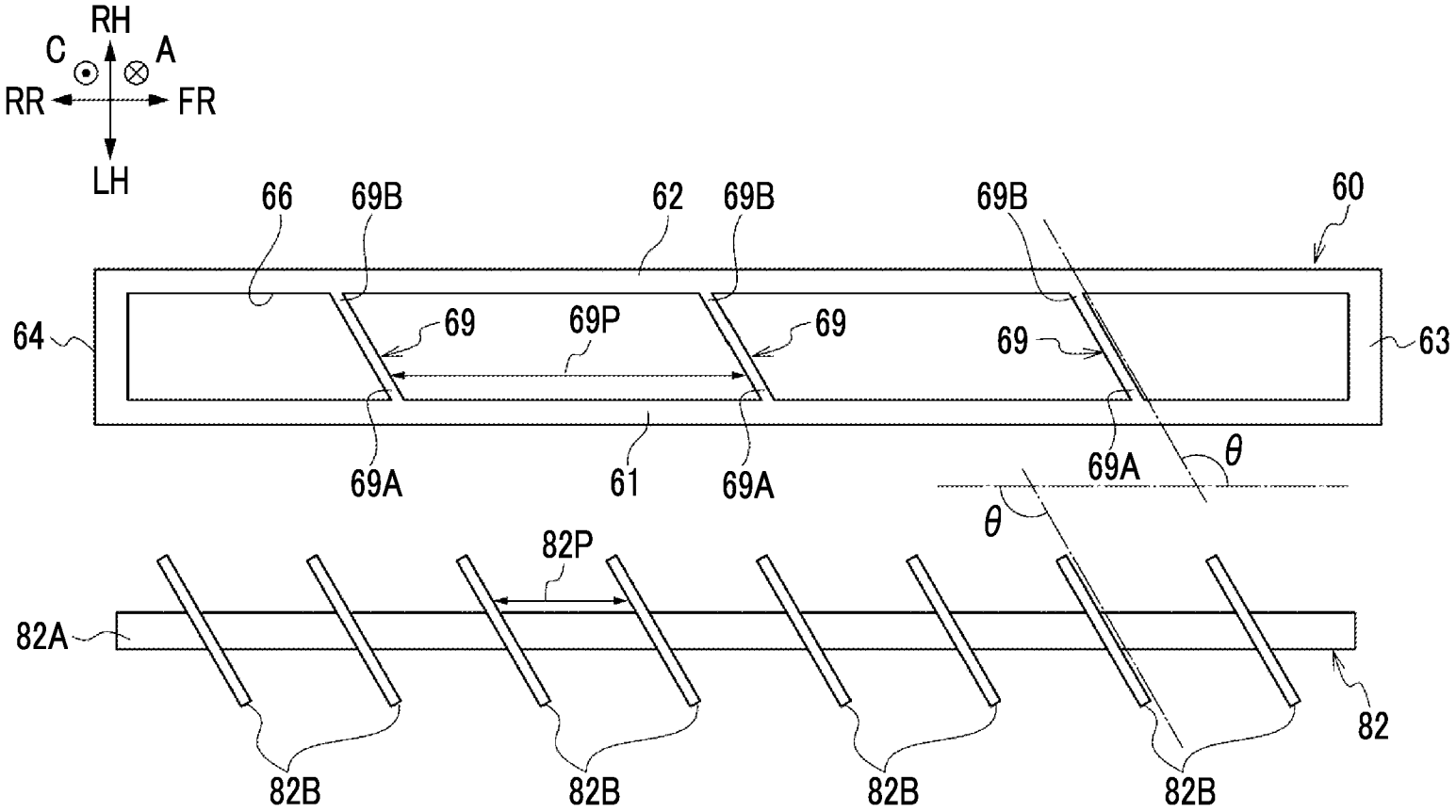
FIG. 3 is a schematic diagram showing an attachment part, connection portions, and a second transport auger according to the present exemplary embodiment.
Figure 4:
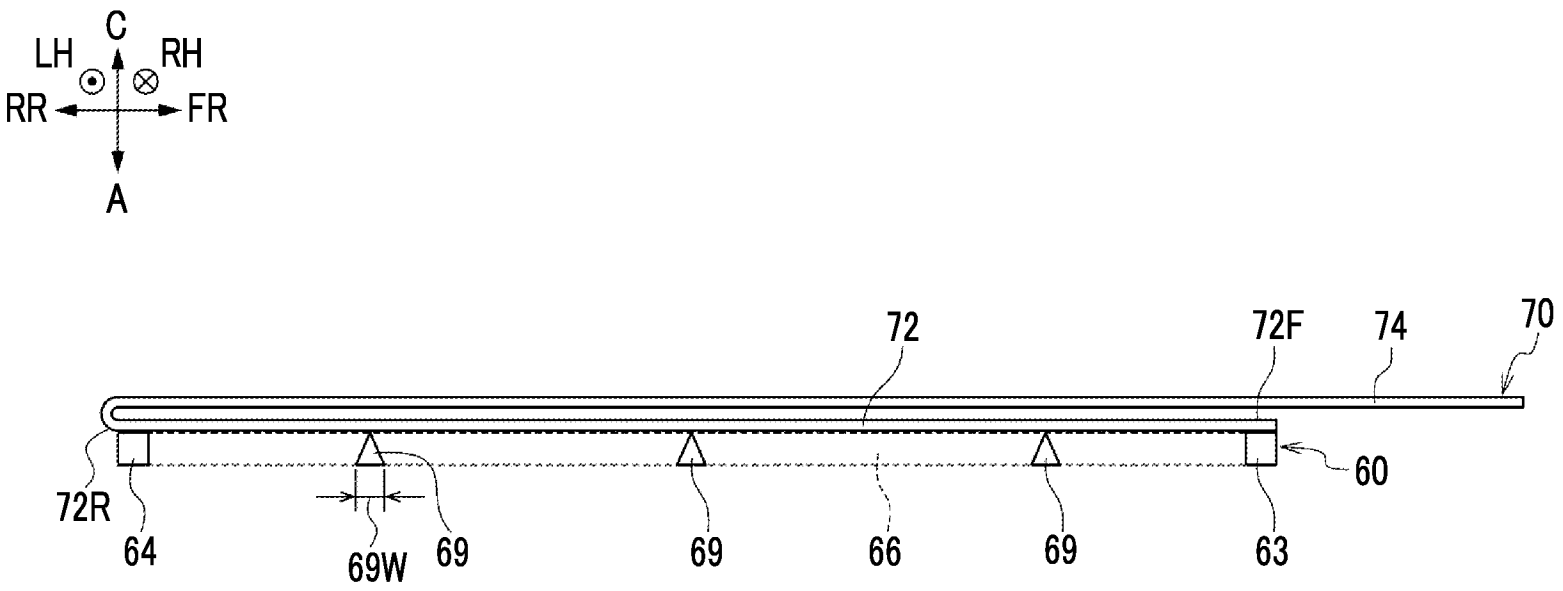
FIG. 4 is a schematic diagram showing the attachment part, the connection portions, and a sealing member according to the present exemplary embodiment.

FIG. 2 is a schematic diagram showing the developing device 38. FIG. 3 is a schematic diagram showing an attachment part 60, connection portions 69, and a second transport auger 82 to be described later of the developing device 38 according to the present exemplary embodiment. FIG. 4 is a schematic diagram showing the attachment part 60, the connection portions 69, and a sealing member 70 to be described later of the developing device 38.

The developing device 38 shown in FIG. 2 is a device that develops the latent image held by the photoreceptor 32 as described above with a developer G. The developer G is a developer that includes toner and a magnetic carrier. Specifically, as shown in FIG. 2, the developing device 38 includes a housing 40, a first transport auger 81, a second transport auger 82, a developing roller 50, a layer regulation member 54, an attachment part 60, a sealing member 70, and connection portions 69 (see FIG. 3). Each part of the developing device 38 will be described below.

Housing 40

The housing 40 shown in FIG. 2 is an example of a storage part, and a developer G is stored in the housing 40. The housing 40 is formed in the shape of a box having a length in the front-rear direction.

A first transport passage 41 and a second transport passage 42 through which the developer G is transported are formed in the housing 40. The first transport passage 41 is disposed in the front-rear direction at a lower right portion of the housing 40. The developer G stored in the housing 40 is transported in a transport direction (specifically, to one side in the front-rear direction) in the first transport passage 41 by the first transport auger 81.

The second transport passage 42 is disposed along the first transport passage 41 to be adjacent to the first transport passage 41 with a partition wall 43 interposed therebetween. Specifically, the second transport passage 42 is disposed in the front-rear direction on an upper left side of the first transport passage 41. A front end portion of the second transport passage 42 is connected to a front end portion of the first transport passage 41, a rear end portion of the second transport passage 42 is connected to a rear end portion of the first transport passage 41, and the second transport passage 42 is partitioned from the first transport passage 41 by a partition wall 43 at an intermediate portion between the front end portion and the rear end portion of the second transport passage 42. The front end portions of the second transport passage 42 and the first transport passage 41 are connected to each other and the rear end portions thereof are connected to each other, so that the first transport passage 41 and the second transport passage 42 form a circulation passage.

The developer G supplied from the first transport passage 41 is stored in the second transport passage 42, and the developer G is transported in a direction opposite to the transport direction (specifically, to the other side in the front-rear direction) by the second transport auger 82.

In addition, in a state where the developing device 38 is installed in each of the toner image forming units 20Y to 20K, an opening portion 44, which is open toward the photoreceptor 32 (specifically, a left side), is formed in the housing 40 as shown in FIG. 2. The photoreceptor 32 in a state where the developing device 38 is installed in each of the toner image forming units 20Y to 20K is shown in FIG. 2 by a two-dot chain line.

First Transport Auger 81 and Second Transport Auger 82

The first transport auger 81 and the second transport auger 82 include spiral blades 81B and 82B, and transport the developer G via the rotation thereof. Specifically, the first transport auger 81 and the second transport auger 82 include shaft portions 81A and 82A that are disposed in the front-rear direction and spiral blades 81B and 82B that are formed on the outer peripheries of the shaft portions 81A and 82A, respectively. The second transport auger 82 is an example of a transport body.

The first transport auger 81 is disposed in the first transport passage 41. In a case where the shaft portion 81A is rotated, the first transport auger 81 transports the developer G in the first transport passage 41 in the transport direction (specifically, to one side in the front-rear direction) by the blade 81B.

The second transport auger 82 is disposed in the second transport passage 42. In a case where the shaft portion 82A is rotated, the second transport auger 82 transports the developer G in the second transport passage 42 in the opposite direction (specifically, to the other side in the front-rear direction) by the blade 82B.

Developing Roller 50 and Layer Regulation Member 54

The developing roller 50 is an example of a developing body, and is a component to which the developer G is supplied from the second transport auger 82. The developing roller 50 is provided in the housing 40 such that a part of the developing roller 50 is exposed from the opening portion 44 of the housing 40. The layer regulation member 54 is provided on the lower side of the developing roller 50.

The developing roller 50 holds the developer G supplied from the second transport auger 82 on the outer peripheral surface thereof, and transports the developer G to a facing position facing the photoreceptor 32. The thickness of a layer of the developer G (the amount of developer) transported toward the facing position is regulated by the layer regulation member 54. Then, the developer G (specifically, toner) present on the developing roller 50 is supplied to the photoreceptor 32 at the facing position, and the electrostatic latent image formed on the photoreceptor 32 is developed with the developer G (specifically, toner).

Attachment Part 60

The attachment part 60 shown in FIGS. 2 and 3 is a structure to which the sealing member 70 (see FIG. 4) is to be attached. Specifically, the attachment part 60 is formed in the shape of a rectangular frame long in the front-rear direction as shown in FIG. 3 as viewed from the developing roller 50 toward the second transport auger 82 (that is, as viewed in a direction of an arrow A shown in FIG. 2). Accordingly, the attachment part 60 includes a first side 61 and a second side 62 that extend in the front-rear direction while having an interval therebetween in the left-right direction, a third side 63 that connects a front end portion of the first side 61 to a front end portion of the second side 62, and a fourth side 64 that connects a rear end portion of the first side 61 to a rear end portion of the second side 62.

In order to make the configuration of the second transport auger 82 and the attachment part 60 easy to see, the second transport auger 82 and the attachment part 60 are shown in FIG. 3 to be shifted from each other in the left-right direction. However, in a case where the second transport auger 82 and the attachment part 60 are viewed in a direction of an arrow A, the second transport auger 82 and the attachment part 60 are actually disposed to overlap with each other (see FIG. 2).

The attachment part 60 is formed in the shape of a plate of which the thickness direction is parallel to the direction of the arrow A (see FIG. 4). That is, the attachment part 60 is formed in a flat shape in the direction of the arrow A. Further, the attachment part 60 is made of a resin material.

The direction of the arrow A shown in each drawing is a direction from the developing roller 50 toward the second transport auger 82. Specifically, the direction of the arrow A is a direction from the central axis of the developing roller 50 toward the central axis of the second transport auger 82 in a side view.

A direction of an arrow C shown in each drawing is a direction from the second transport auger 82 toward the developing roller 50. Specifically, the direction of the arrow C is a direction from the central axis of the second transport auger 82 toward the central axis of the developing roller 50 in a side view. That is, the direction of the arrow C is a direction opposite to the direction of the arrow A. A direction of an arrow B shown in FIG. 2 is a direction orthogonal to the direction of the arrow A and the direction of the arrow C.

As shown in FIG. 2, the attachment part 60 is disposed between the second transport auger 82 and the developing roller 50. The attachment part 60 is supported by the housing 40. Specifically, the first and second sides 61 and 62 are inserted into recessed portions 48 formed in the housing 40 in the front-rear direction, so that the attachment part 60 is supported by the housing 40.

As shown in FIG. 3, the attachment part 60 includes an opening 66 that allows the developer G supplied from the second transport auger 82 to the developing roller 50 to pass. Specifically, the opening 66 is formed of a space that is surrounded by the first side 61, the second side 62, the third side 63, and the fourth side 64.

Sealing Member 70

The sealing member 70 is a component that seals the opening 66. The sealing member 70 is detachably attached to the attachment part 60. The sealing member 70 allows the developer G to move from the second transport auger 82 to the developing roller 50 through the opening 66 by being removed.

The sealing member 70 is formed in a film shape (that is, a membrane shape). Specifically, the sealing member 70 is formed of, for example, a film made of a resin. The sealing member 70 is bonded to the attachment part 60 by, for example, fusion bonding (so-called heat sealing) to cover the opening 66.

Figure 5:
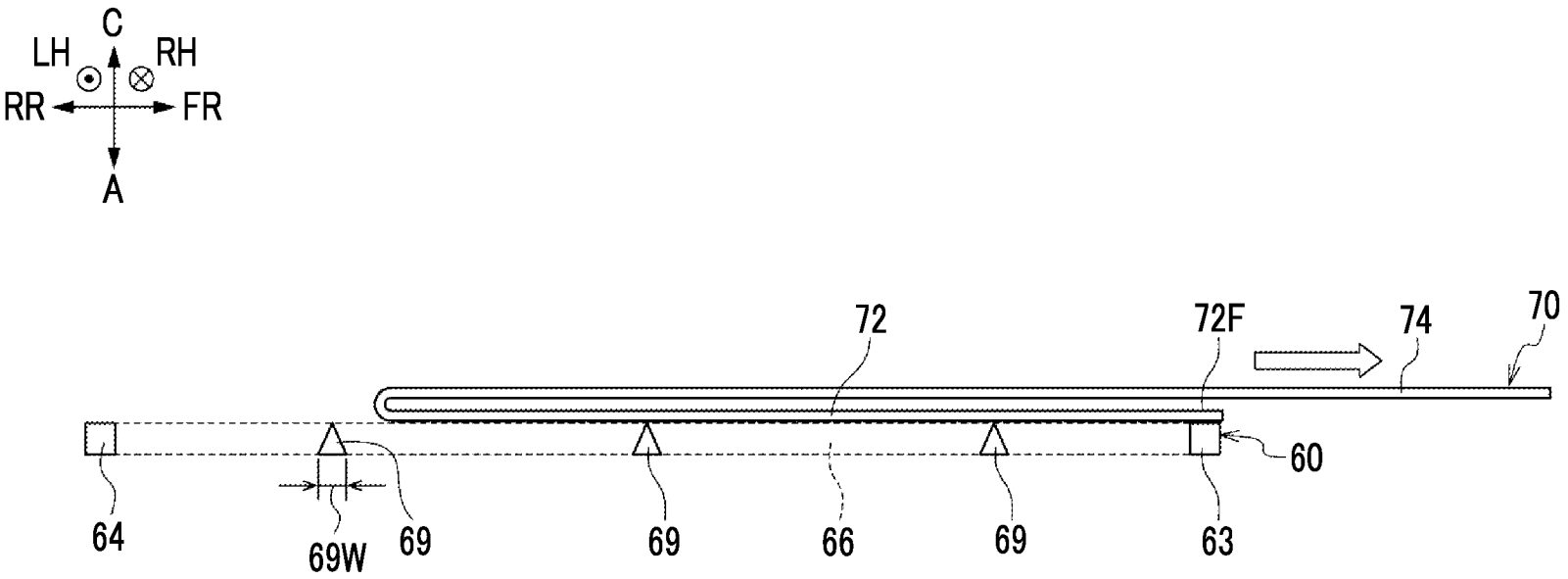
FIG. 5 is a schematic diagram showing a process for detaching the sealing member in a form shown in FIG. 4.

Specifically, the sealing member 70 includes a sealing portion 72 and a pull-out portion 74 as shown in FIG. 4. The sealing portion 72 is a portion that seals the entire opening 66. The pull-out portion 74 is a portion that is to be connected to one end portion 72R (specifically, a rear end portion) of the sealing portion 72 and is to be pulled out to one side (specifically, a front side) corresponding to a direction from one end portion 72R of the sealing portion 72 toward the other end portion 72F (specifically, a front end portion). In a case where the pull-out portion 74 of the sealing member 70 is pulled out to the front side by a user, the sealing member 70 is detached from the attachment part 60 as shown in FIG. 5.

The sealing member may be formed of a film made of metal, and various sealing members can be used. Further, the sealing member may be bonded to the attachment part 60 by a bonding method using a bonding agent, such as an adhesive, or other bonding methods.

Connection Portion 69

Each connection portion 69 is a structural portion that is connected to the attachment part 60. Specifically, each connection portion 69 extends to cross the opening 66 at a spiral angle θ of the blade 82B of the second transport auger 82 as viewed in the direction of the arrow A, and one end portion 69A and the other end portion 69B of each connection portion 69 are connected to the attachment part 60.

Specifically, one end portion 69A of the connection portion 69 is connected to the first side 61 of the attachment part 60, and the other end portion 69B of the connection portion 69 is connected to the second side 62 of the attachment part 60. That is, the connection portion 69 extends to the second side 62 from the first side 61 of the attachment part 60.

The connection portions 69 are linearly formed at the spiral angle of the blade 82B. Accordingly, the connection portions 69 are inclined with respect to the shaft portion 82A of the second transport auger 82. In the present exemplary embodiment, the connection portions 69 have a thickness identical to the thickness of the attachment part 60 in the direction of the arrow A and are formed integrally with the attachment part 60. Further, the connection portions 69 are made of a material identical to the attachment part 60. In the present exemplary embodiment, the connection portions 69 are made of a resin material.

The connection portions 69 may be formed separately from the attachment part 60. Further, the connection portions 69 may be made of a material different from the material of the attachment part 60.

Here, the spiral angle θ is the angle (obtuse angle) of the blade 82B with respect to an axial direction of the shaft portion 82A in a case where the second transport auger 82 is viewed from the developing roller 50 (that is, the second transport auger 82 is viewed in the direction of the arrow A).

Further, a configuration in which the connection portions 69 are arranged at the spiral angle θ of the blade 82B does not need to be a configuration in which the arrangement direction of the connection portions 69 completely match the spiral angle θ of the blade 82B, and also includes a case where, for example, the connection portions 69 are arranged to have an angle in the range of a predetermined angle (for example, ±30° from the spiral angle θ.

A width 69W of the connection portion 69 in a rotation axis direction of the second transport auger 82 at a downstream end portion of the connection portion 69 in a supply direction from the second transport auger 82 toward the developing roller 50 (the direction of the arrow C) is less than a width 69W thereof at an upstream end portion of the connection portion 69.

Specifically, the width 69W of the connection portion 69 in the rotation axis direction of the second transport auger 82 is gradually reduced in the supply direction. More specifically, the connection portions 69 are formed at an acute angle in the supply direction.

Specifically, the width 69W of the connection portion 69 in the rotation axis direction of the second transport auger 82 is set to 1 mm or less. The width 69W mentioned here is the maximum width of the connection portion 69. In the present exemplary embodiment, the width 69W is the width 69W of the connection portion 69 at the upstream end portion of the connection portion 69 in the supply direction from the second transport auger 82 toward the developing roller 50 (the direction of the arrow C).

A plurality of connection portions 69 are arranged in the rotation axis direction of the second transport auger 82. An interval 69P between the connection portions 69 in the rotation axis direction is equal to or larger than a spiral interval 82P of the blade 82B. The spiral interval 82P means an axial length of the blade 82B per 360° (one turn) in a circumferential direction of the shaft portion 82A.

In addition, the interval 69P between the connection portions 69 is set to an integral multiple of the spiral interval 82P of the blade 82B in the present exemplary embodiment.

That is, the interval 69P between the connection portions 69 is set to be equal to a value that is the product of the spiral interval 82P and an integer.

The sealing member 70 may be detachably attached to the connection portions 69 in addition to the attachment part 60. In this case, the pull-out portion 74 is pulled out to the front side by a user, so that the sealing member 70 is detached from the attachment part 60 and the connection portions 69.

Action of Present Exemplary Embodiment

In the present exemplary embodiment, one end portion 69A and the other end portion 69B of each connection portion 69 are connected to the attachment part 60 as shown in FIG. 3.

Figure 6:
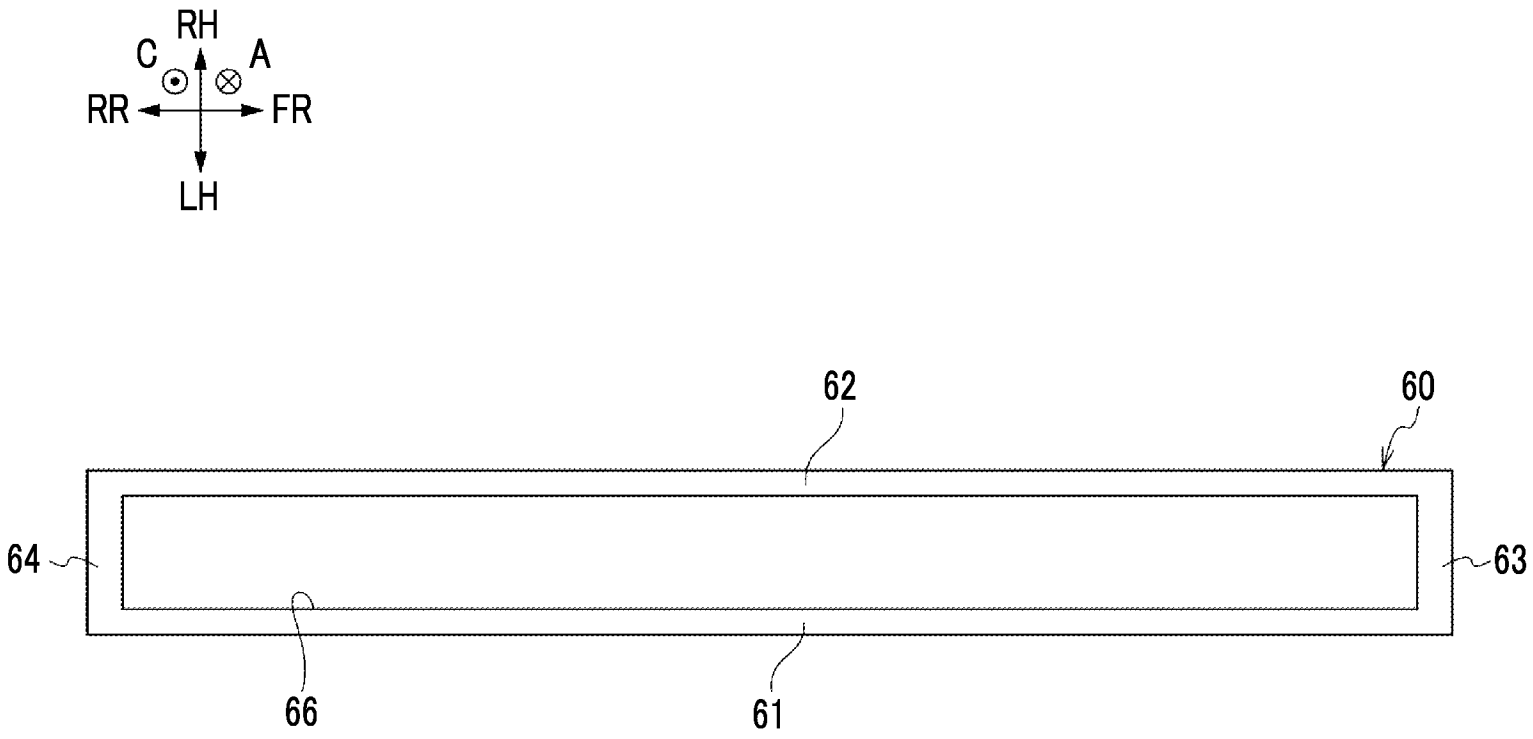
FIG. 6 is a schematic diagram showing a form not including the connection portions.
Figure 7:
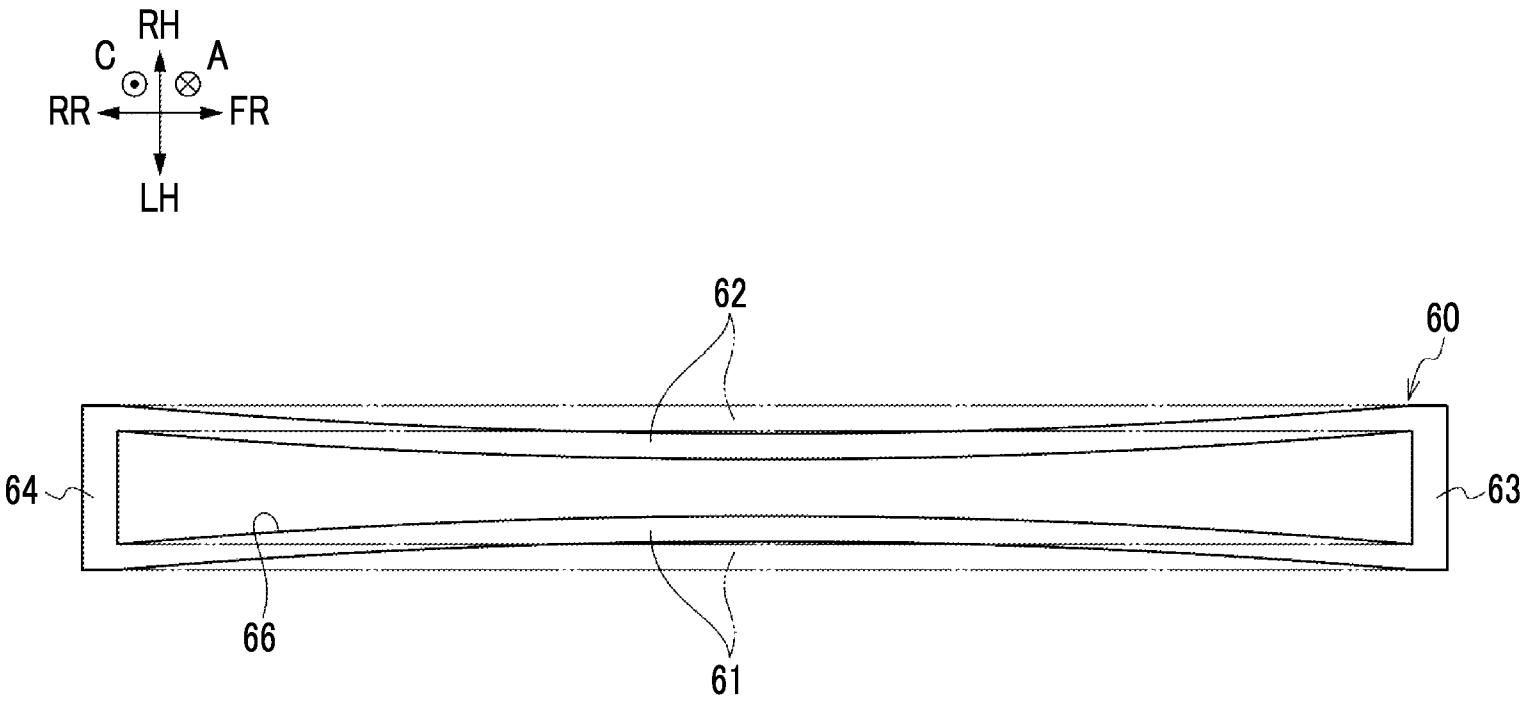
FIG. 7 is a schematic diagram showing a state in which deformation occurs in a form shown in FIG. 6.

Here, since the stiffness of the attachment part 60 is low in a form not including the connection portions 69 (hereinafter, referred to as a form A) as shown in FIG. 6, the attachment part 60 is likely to be deformed as shown in FIG. 7. Further, since the supply of a developer G from the second transport auger 82 to the developing roller 50 is hindered in a case where the first and second sides 61 and 62 are deformed inward as shown in FIG. 7, the poor supply of the developer G may occur.

In contrast, since one end portion 69A and the other end portion 69B of each connection portion 69 are connected to the attachment part 60 in the present exemplary embodiment, the deformation of the attachment part 60 is suppressed as compared to the form A. As a result, according to the present exemplary embodiment, the poor supply of a developer G caused by the deformation of the attachment part 60 is suppressed as compared to the form A.

Figure 8:
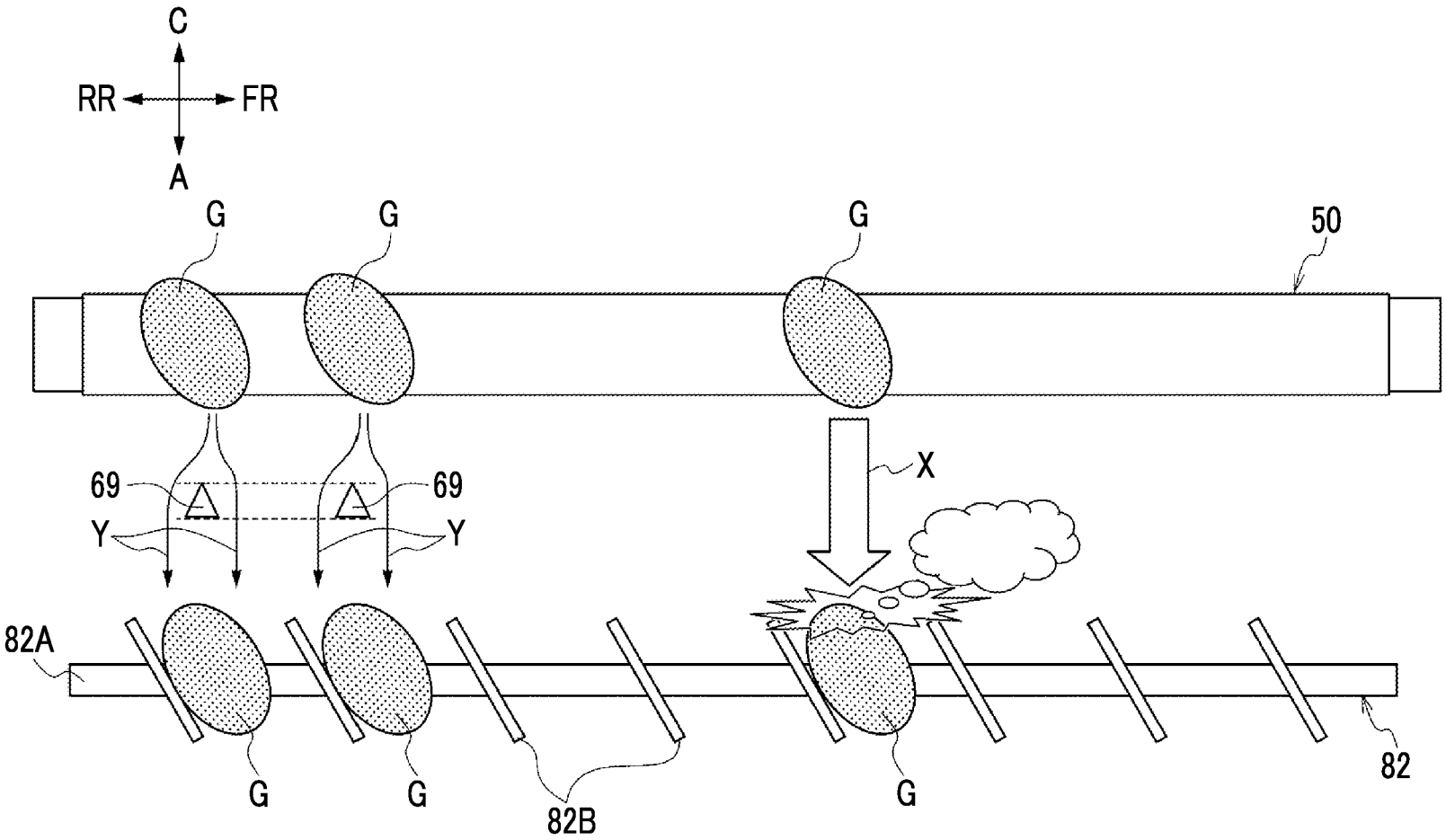
FIG. 8 is a schematic diagram showing a case where a developer separated from a developing roller according to the present exemplary embodiment falls onto the second transport auger.

Further, in a case where a developer G separated from the developing roller 50 falls onto the second transport auger 82, the developer G is likely to directly collide with the second transport auger 82 in the form A as shown by an arrow X of FIG. 8. For this reason, the developer G is likely to float.

In contrast, one end portion 69A and the other end portion 69B of each connection portion 69 are connected to the attachment part 60 in the present exemplary embodiment. Accordingly, since the developer G comes into contact with the connection portions 69 as shown by an arrow Y of FIG. 8 in a case where a developer G separated from the developing roller 50 falls onto the second transport auger 82, a cushioning effect is obtained as compared to the form A. For this reason, the developer G is less likely to float.

Furthermore, in the present exemplary embodiment, each connection portion 69 extends to cross the opening 66 at the spiral angle θ of the blade 82B of the second transport auger 82 as viewed in the direction of the arrow A, and one end portion 69A and the other end portion 69B of each connection portion 69 are connected to the attachment part 60.

Figure 9:
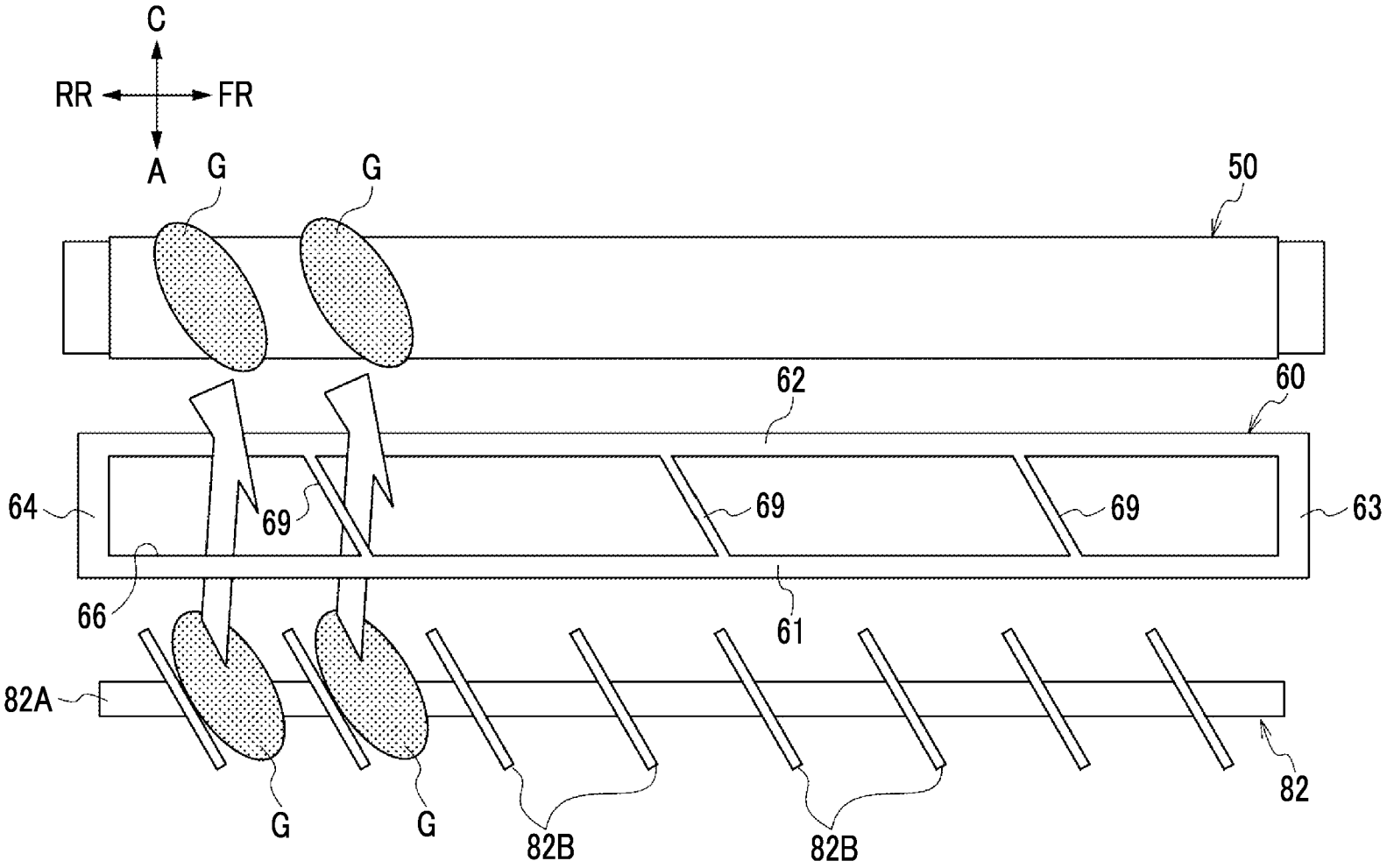
FIG. 9 is a schematic diagram showing a state where a developer is supplied to the developing roller from the second transport auger according to the present exemplary embodiment.

Here, the developer G adhering to the blade 82B of the second transport auger 82 is disposed at the spiral angle θ of the blade 82B, and is supplied to the developing roller 50 (see FIG. 9).

For this reason, since the supply of the developer G from the second transport auger 82 to the developing roller 50 is less likely to be hindered as compared to a case where the connection portions 69 extend in a direction orthogonal to a direction corresponding to the spiral angle θ of the blade 82B (hereinafter, referred to as a form B), the poor supply of the developer G from the second transport auger 82 to the developing roller 50 is suppressed. As a result, an image defect occurring in an image formed on the recording medium P is suppressed in the image forming apparatus 10 as compared to the form B.

Further, the width 69W of the connection portion 69 in the rotation axis direction of the second transport auger 82 at a downstream end portion of the connection portion 69 in the supply direction from the second transport auger 82 toward the developing roller 50 (the direction of the arrow C) is less than the width 69W thereof at an upstream end portion of the connection portion 69 in the present exemplary embodiment.

Figure 10:
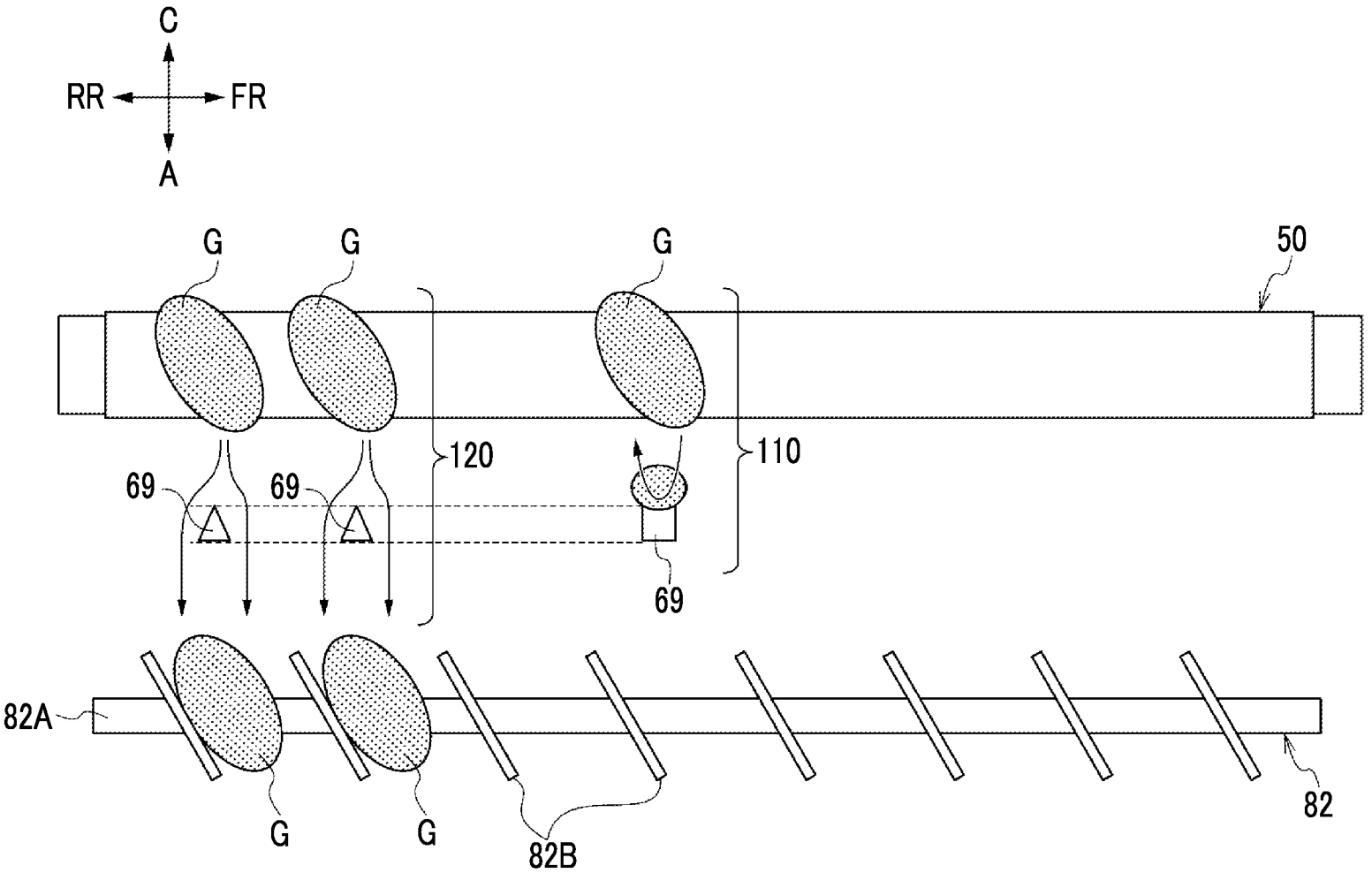
FIG. 10 is a schematic diagram showing a case where a developer separated from the developing roller according to the present exemplary embodiment stays on the connection portions.

Here, in a case where the width 69W of the connection portion 69 at the downstream end portion of the connection portion 69 in the supply direction is equal to the width 69W thereof at the upstream end portion (hereinafter, referred to as a form C), a developer G separated from the developing roller 50 may adhere to the downstream end portion of the connection portion 69 and stay as denoted by reference numeral 110 of FIG. 10. As a result, the developer G, which stays at the downstream end portion of the connection portion 69, may be supplied to the developing roller 50 again.

In contrast, since the width 69W of the connection portion 69 at the downstream end portion of the connection portion 69 in the supply direction is less than the width 69W thereof at the upstream end portion of the connection portion 69 in the present exemplary embodiment, the stay of a developer G separated from the developing roller 50 at the downstream end portion of the connection portion 69 is suppressed as compared to the form C.

Further, the width 69W of the connection portion 69 in the rotation axis direction of the second transport auger 82 is gradually reduced in the supply direction in the present exemplary embodiment. For this reason, the stay of a developer G separated from the developing roller 50 at the downstream end portion of the connection portion 69 is suppressed as compared to a case where the width 69W of the connection portion 69 is reduced in stages in the supply direction.

Furthermore, the connection portions 69 are formed at an acute angle in the supply direction in the present exemplary embodiment. For this reason, the stay of a developer G separated from the developing roller 50 at the downstream end portion of the connection portion 69 is suppressed as compared to a case where the connection portions 69 are formed at an obtuse angle in the supply direction.

Moreover, the interval 69P between the connection portions 69 in the rotation axis direction is set to be equal to or larger than the spiral interval 82P of the blade 82B in the present exemplary embodiment. For this reason, since the supply of a developer G from the second transport auger 82 to the developing roller 50 is less likely to be hindered as compared to a case where the interval 69P between the connection portions 69 in the rotation axis direction is less than the spiral interval 82P of the blade 82B, the poor supply of the developer G from the second transport auger 82 to the developing roller 50 is suppressed.

Further, the interval 69P between the connection portions 69 is set to an integral multiple of the spiral interval 82P of the blade 82B in the present exemplary embodiment. For this reason, since the supply of a developer G from the second transport auger 82 to the developing roller 50 is less likely to be hindered as compared to a case where the interval 69P between the connection portions 69 is larger than the spiral interval 82P of the blade 82B and is an interval different from an integral multiple of the spiral interval 82P of the blade 82B, the poor supply of the developer G from the second transport auger 82 to the developing roller 50 is suppressed.

Furthermore, the width 69W of the connection portion 69 in the rotation axis direction of the second transport auger 82 is set to 1 mm or less in the present exemplary embodiment.

For this reason, since the supply of a developer G from the second transport auger 82 to the developing roller 50 is less likely to be hindered as compared to a case where the width 69W of the connection portion 69 in the rotation axis direction of the second transport auger 82 exceeds 1 mm, the poor supply of the developer G from the second transport auger 82 to the developing roller 50 is suppressed.

Modification Examples

The width 69W of the connection portion 69 at the downstream end portion of the connection portion 69 in the supply direction is set to be less than the width 69W thereof at the upstream end portion of the connection portion 69 in the present exemplary embodiment, but is not limited thereto. For example, the width 69W of the connection portion 69 at the downstream end portion of the connection portion 69 in the supply direction may be equal to the width 69W thereof at the upstream end portion of the connection portion 69.

Further, the width 69W of the connection portion 69 in the rotation axis direction of the second transport auger 82 is gradually reduced in the supply direction in the present exemplary embodiment, but is not limited thereto. For example, the width 69W of the connection portion 69 may be reduced in stages in the supply direction.

Furthermore, the connection portions 69 are formed at an acute angle in the supply direction in the present exemplary embodiment, but are not limited thereto. For example, the connection portions 69 may be formed at an obtuse angle in the supply direction. Moreover, for example, portions having a circular shape, a semicircular shape, an elliptical shape, a rhombus shape, and the like as a cross-sectional shape viewed in the left-right direction may be used as the connection portion 69.

Further, the interval 69P between the connection portions 69 in the rotation axis direction is set to be equal to or larger than the spiral interval 82P of the blade 82B in the present exemplary embodiment, but is not limited thereto. For example, the interval 69P between the connection portions 69 in the rotation axis direction may be less than the spiral interval 82P of the blade 82B.

Furthermore, the interval 69P between the connection portions 69 is set to an integral multiple of the spiral interval 82P of the blade 82B in the present exemplary embodiment, but is not limited thereto. For example, the interval 69P between the connection portions 69 may be larger than the spiral interval 82P of the blade 82B and may be an interval different from the integral multiple of the spiral interval 82P of the blade 82B.

Moreover, the width 69W of the connection portion 69 in the rotation axis direction of the second transport auger 82 is set to 1 mm or less in the present exemplary embodiment, but is not limited thereto. For example, the width 69W of the connection portion 69 in the rotation axis direction of the second transport auger 82 may exceed 1 mm.

In addition, the respective connection portions 69 may have different shapes, different dimensions, and the like.

The present invention is not limited to the above-mentioned exemplary embodiment and may include various modifications, alterations, or improvements without departing from the scope of the present invention. For example, a plurality of modification examples among the above-mentioned modification examples may be appropriately combined.

(((1)))

A developing device comprising:

a storage part in which a developer is stored;

a transport body that includes a spiral blade and transports the developer via a rotation thereof;

a developing body to which the developer is supplied from the transport body;

an attachment part which is disposed between the transport body and the developing body and includes an opening allowing the developer supplied from the transport body to the developing body to pass and to which a sealing member sealing the opening is detachably attached; and a connection portion which extends to cross the opening at a spiral angle of the blade as viewed from the developing body toward the transport body and of which one end portion and the other end portion are connected to the attachment part.

(((2)))

The developing device according to (((1))), wherein a width of the connection portion in a rotation axis direction of the transport body at a downstream end portion of the connection portion in a supply direction from the transport body toward the developing body is less than the width thereof at an upstream end portion of the connection portion.

(((3)))

The developing device according to (((2))), wherein the width of the connection portion in the rotation axis direction of the transport body is gradually reduced in the supply direction.

(((4)))

The developing device according to (((3))), wherein the connection portion is formed at an acute angle in the supply direction.

(((5)))

The developing device according to any one of (((1))) to (((4))), wherein a plurality of connection portions are arranged in the rotation axis direction of the transport body, and an interval between the connection portions in the rotation axis direction is equal to or larger than a spiral interval of the blade.

(((6)))

The developing device according to (((5))), wherein an interval between the connection portions in the rotation axis direction is an integral multiple of the spiral interval of the blade.

(((7)))

The developing device according to any one of (((1))) to (((6))), wherein the width of the connection portion in the rotation axis direction of the transport body is 1 mm or less.

(((8)))

An image forming apparatus comprising:

a holding body that holds a latent image; and the developing device according to any one of (((1))) to (((7))) that develops the latent image.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a storage part in which a developer is stored;

a transport body that includes a spiral blade and transports the developer via a rotation thereof;

a developing body to which the developer is supplied from the transport body;

an attachment part which is disposed between the transport body and the developing body and includes an opening allowing the developer supplied from the transport body to the developing body to pass and to which a sealing member sealing the opening is detachably attached; and a connection portion which extends to cross the opening at a spiral angle of the blade as viewed from the developing body toward the transport body and of which one end portion and the other end portion are connected to the attachment part.

2. The developing device according to claim 1, wherein a width of the connection portion in a rotation axis direction of the transport body at a downstream end portion of the connection portion in a supply direction from the transport body toward the developing body is less than the width thereof at an upstream end portion of the connection portion.

3. The developing device according to claim 2, wherein the width of the connection portion in the rotation axis direction of the transport body is gradually reduced in the supply direction.

4. The developing device according to claim 3, wherein the connection portion is formed at an acute angle in the supply direction.

5. An image forming apparatus comprising:

a holding body that holds a latent image; and the developing device according to claim 4 that develops the latent image.

6. An image forming apparatus comprising:

a holding body that holds a latent image; and the developing device according to claim 3 that develops the latent image.

7. An image forming apparatus comprising:

a holding body that holds a latent image; and the developing device according to claim 2 that develops the latent image.

8. The developing device according to claim 1, wherein a plurality of connection portions are arranged in a rotation axis direction of the transport body, and an interval between the connection portions in the rotation axis direction is equal to or larger than a spiral interval of the blade.

9. The developing device according to claim 8, wherein the interval between the connection portions in the rotation axis direction is an integral multiple of the spiral interval of the blade.

10. An image forming apparatus comprising:

a holding body that holds a latent image; and the developing device according to claim 9 that develops the latent image.

11. An image forming apparatus comprising:

a holding body that holds a latent image; and the developing device according to claim 8 that develops the latent image.

12. The developing device according to claim 1, wherein a width of the connection portion in a rotation axis direction of the transport body is 1 mm or less.

13. An image forming apparatus comprising:

a holding body that holds a latent image; and the developing device according to claim 12 that develops the latent image.

14. An image forming apparatus comprising:

a holding body that holds a latent image; and the developing device according to claim 1 that develops the latent image.

* * * * *